United States Patent [19]

Gutleber

[11] Patent Number: 4,580,141

[45] Date of Patent: Apr. 1, 1986

[54] LINEAR ARRAY ANTENNA EMPLOYING THE SUMMATION OF SUBARRAYS

[75] Inventor: Frank S. Gutleber, Little Silver, N.J.

[73] Assignee: The United States of America as represented by the Secretary of the Army, Washington, D.C.

[21] Appl. No.: 533,089

[22] Filed: Sep. 19, 1983

[51] Int. Cl.[4] ..... H01Q 21/08

[52] U.S. Cl. ..... 343/844

[58] Field of Search ..... 343/844, 853

[56] References Cited

U.S. PATENT DOCUMENTS

| | | | |
|---|---|---|---|
| 2,834,014 | 5/1958 | Thorne | 343/771 |
| 2,911,644 | 11/1959 | Stavis | 343/771 |
| 3,130,410 | 4/1964 | Gutleber . | |
| 3,182,330 | 5/1965 | Blume | 343/844 |
| 3,605,106 | 9/1971 | Gutleber . | |
| 4,071,848 | 1/1978 | Leeper | 343/844 |

*Primary Examiner*—Eli Lieberman

*Attorney, Agent, or Firm*—Anthony T. Lane; Jeremiah G. Murray; Edward Goldberg

[57] ABSTRACT

A coded linear array antenna comprised of a plurality of multiple element subarrays, each providing sin mx/sin x patterns which are combined, i.e. summed into a composite pattern by having the subarrays commonly connected to a signal summation means. Each subarray is comprised of multiple elements which are respectively spaced equidistantly apart and positioned symmetrically on either side of a common array axis center or axis of symmetry and wherein the individual antenna elements of each subarray are positioned at an $i_{th}$ location according to the normalized equation $$n'_i = \frac{n_m}{2} - \left(\frac{h-1}{2}\right) n + (i-1)n$$

where $i = 1, 2, 3, \ldots h$, $n_m$ defines the maximum number of elements in the length or aperture of the composite array, h is the number of elements in the respective subarray, and n is proportional to the element spacing of the respective subarray.

7 Claims, 2 Drawing Figures

LINEAR ARRAY ANTENNA EMPLOYING THE SUMMATION OF SUBARRAYS

The invention described herein may be manufactured, used and licensed by or for the Government for governmental purposes without the payment of any royalties thereon or therefor.

FIELD OF THE INVENTION

This invention relates generally to coded linear array antennas and more particularly to a design procedure which utilizes the total flexibility of controlling both element space positions and/or amplitude levels.

BACKGROUND OF THE INVENTION

Space coded linear array antennas and methods for obtaining a desired antenna pattern therefrom are shown and described in applicant's prior U.S. Pat. No. 3,130,410, entitled, "Space Coded Linear Array Antennas" issuing on Apr. 21, 1964, and U.S. Pat. No. 3,605,106, entitled, "Slot Fitting of Coded Linear Array Antenna", issuing on Sept. 14, 1971, which patents are furthermore incorporated herein by reference. In U.S. Pat. No. 3,130,410, there is disclosed the concept of sidelobe control of linear array antennas by amplitude and/or space coding of antenna elements and which comprises adding a second element to each existing element in order to force a zero in an antenna pattern for some specific value of space angle. In U.S. Pat. No. 3,605,106, another method of designing a coded array antenna is disclosed which is more general and involves adding h−1 additional elements to each element of an array whose vector fields are the $h_{th}$ complex roots of unity.

SUMMARY OF THE INVENTION

Briefly, the subject invention is directed to a method for designing a linear array antenna whereby undesired side lobes are reduced by controlling both element amplitude and space positions using sums of antenna patterns formed by a plurality of uniform subarrays each comprising multiple elements which are spaced equidistantly from one another in each array and centered about a common axis of symmetry and with positioning of individual antenna elements being determined in accordance with the normalized equation $$n'_i = \frac{n_m}{2} - \left(\frac{h-1}{2}\right) n + (i-1)n$$

where i=1, 2, 3, . . . h, $n_m$ is equal to the maximum number of elements in the length of the array, h is the total number of elements in the respective subarray and n is proportional to the spacing between elements of that subarray.

DESCRIPTION OF THE PREFERRED EMBODIMENT

Figure 1:
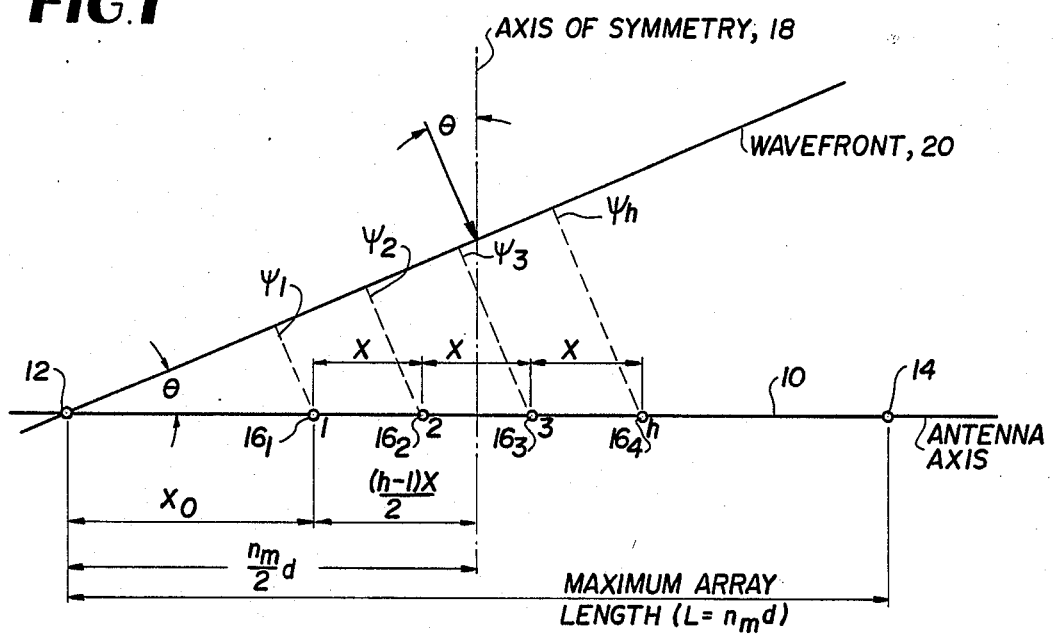
FIG. 1 is a diagram illustrating the geometry of one subarray of a linear array antenna and which is helpful in deriving the equations involved in the subject invention.

Referring now to the drawings and more particularly to FIG. 1, reference numeral 10 denotes a linear antenna axis which has a maximum array length $L=n_m d$ wherein $n_m$ is equal to the maximum number of elements h which can be positioned between the aperture of the array, as defined by the points 12 and 14, for a predetermined constant spacing d. As shown, h=4 elements $\mathbf{16}_1$, $\mathbf{16}_2$, $\mathbf{16}_3$ and $\mathbf{16}_4$ which are symmetrically positioned on either side of the axis of symmetry 18 such that the elements $\mathbf{16}_1$ and $\mathbf{16}_2$ lie on the left side of the axis 18 whereas the elements $\mathbf{16}_3$ and $\mathbf{16}_4$ lie on the right hand side of said axis. Moreover, the elements $\mathbf{16}_1 \ldots \mathbf{16}_4$ have a mutually constant spacing of "x" with the first element $\mathbf{16}_1$ being spaced from point 12 by a distance of $x_0$. The first element $\mathbf{16}_1$, moreover, is positioned from the axis of symmetry 18 by a distance of $$\left(\frac{h-1}{2}\right) x.$$

Thus the subarray is comprised of multiple elements which are respectively spaced equidistantly apart and positioned symmetrically on either side of a common axis.

Accordingly, a wave front 20 arriving at a space angle $\theta$ with respect to the antenna axis 10 will impinge on the antenna elements $\mathbf{16}_1 \ldots \mathbf{16}_4$ with received radiation phases of $\psi_1$, $\psi_2$, $\psi_3$ and $\psi_h$, respectively. The design equations for positioning of the elements are developed as follows.

The resultant received $E_t$ signal for the subarray shown in FIG. 1 can be represented by the following equation:

$$E_t = e^{j\psi_1} + e^{j\psi_2} + \ldots + e^{j\psi_h} \tag{1}$$

where: $\psi_1 = \frac{2\pi}{\lambda} x_0 \sin\theta$ $$\psi_2 = \frac{2\pi}{\lambda}(x_0 + x)\sin\theta$$

$$\psi_3 = \frac{2\pi}{\lambda}(x_0 + 2x)\sin\theta$$

$$\vdots$$

$$\psi_h = \frac{2\pi}{\lambda}[x_0 + (h-1)x]\sin\theta$$

where $\lambda$ is equal to the wavelength of the incident radiation and $\theta$ is equal to space angle.

Now let $$\psi = \frac{2\pi}{\lambda} d \sin\theta \tag{2}$$

where d corresponds to a predetermined arbitrary constant element spacing.

Making the following substitution, $$K = \frac{d\sin\theta}{\lambda}$$

yields, $$\psi = 2\pi K \tag{3}$$

Combining equations (1) and (2) results in:

$$E_t = e^{j\psi \frac{x0}{d}} \left[ 1 + e^{j\psi(\frac{x}{d})} + e^{j2\psi(\frac{x}{d})} + \ldots + e^{j(h-1)\psi(\frac{x}{d})} \right] \tag{4}$$

where (x/d) is proportional to the element spacing.

Now letting (x/d)=n, equations (3) and (4) can be combined as:

$$E_t = e^{j2\pi K(\frac{x0}{d})} [1 + e^{j2\pi Kn} + e^{j2(2\pi K)n} + \ldots + e^{j(h-1)2\pi Kn}] \tag{5}$$

The bracketed term in equation (5) can furthermore be reduced to a (sin $m_x$/sin x) function in the following manner.

Consider the equation $$E_t = 1 + e^{j\theta} + e^{j2\theta} + \ldots + e^{j(n-1)\theta} \tag{6}$$

Factoring out $e^{-j\theta}$ yields $$E_t = e^{-j\theta}(e^{j\theta} + e^{j2\theta} + \ldots + e^{jn\theta}) \tag{7}$$

$$e^{j\theta}E_t = (\cos\theta + \cos 2\theta + \ldots + \cos n\theta) + j(\sin\theta + \sin 2\theta + \ldots + \sin n\theta) \tag{8}$$

Which becomes, $$e^{j\theta}E_t = \frac{\sin n\,\theta/2 \cos(n \pm 1)\,\theta/2}{\sin\theta/2} + j\frac{\sin n\,\theta/2 \sin(n+1)\,\theta/2}{\sin\theta/2} \tag{9}$$

$$e^{j\theta}E_t = \frac{\sin n\,\theta/2}{\sin\theta/2} [\cos(n+1)\theta/2 + j\sin(n+1)\theta/2] \tag{10}$$

whereupon, $$E_t = \frac{\sin n\,\theta/2}{\sin\theta/2} e^{j[(n+1)\theta/2 - \theta]} \tag{11}$$

Or, $$E_t = \frac{\sin n\,\theta/2}{\sin\theta/2} e^{j(n-1)\theta/2} \tag{12}$$

In the same manner, equation (5) may be reduced to the form:

$$E_t = e^{j2\pi K\left(\frac{x_0}{d}\right)} \frac{\sin(h\,\pi\,K_n)}{\sin(\pi\,K_n)} e^{j(h-1)\pi K_n} \tag{13}$$

Combining the phase terms results in:

$$E_t = \frac{\sin(h\,\pi\,K_n)}{\sin(\pi\,K_n)} e^{j\pi K[\frac{2x0}{d} + (h-1)n]} \tag{14}$$

Now the glometry of FIG. 1, $$x_0 = \frac{n_m}{2} d - \left(\frac{h-1}{2}\right) x \tag{15}$$

or

-continued $$\frac{2x_0}{d} = n_m - (h-1)n \tag{16}$$

Hence, equation (14) simplifies to:

$$E_t = \frac{\sin(h\,\pi\,K_n)}{\sin(\pi\,K_n)} e^{j\pi K\,n_m} \tag{17}$$

In general, a plurality of subarrays with different spacings and amplitudes positioned with their center at ($n_m$d/ 2) would simply result in a composite pattern given by the sum of the individual patterns, that is, $$E_t = \sum_{i=1}^{n} a_i \frac{\sin(h_i\,\pi\,K\,n_i)}{\sin(\pi\,K_{ni})} e^{j\pi K n_m} \tag{18}$$

where the element amplitudes are given by $a_i$, the element spacings are equal to $n_i \times d$ and $h_i$ is the number of elements in the $i_{th}$ subarray.

The normalized element positions n' for each h element subarray are furthermore given by, $$n'_1 = \frac{n_m}{2} - \left(\frac{h-1}{2}\right) n$$

$$n'_2 = \frac{n_m}{2} - \left(\frac{h-1}{2}\right) n + n$$

$$n'_3 = \frac{n_m}{2} - \left(\frac{h-1}{2}\right) n + 2n$$

$$\vdots$$

$$n'_h = \frac{n_m}{2} - \left(\frac{h-1}{2}\right) n + (h-1)n$$

The above set of equations can be written more compactly as, $$n_i^1 = \frac{n_m}{2} - \left(\frac{h-1}{2}\right) n + (i-1)n$$

where i=1, 2, 3, . . . h

Figure 2:
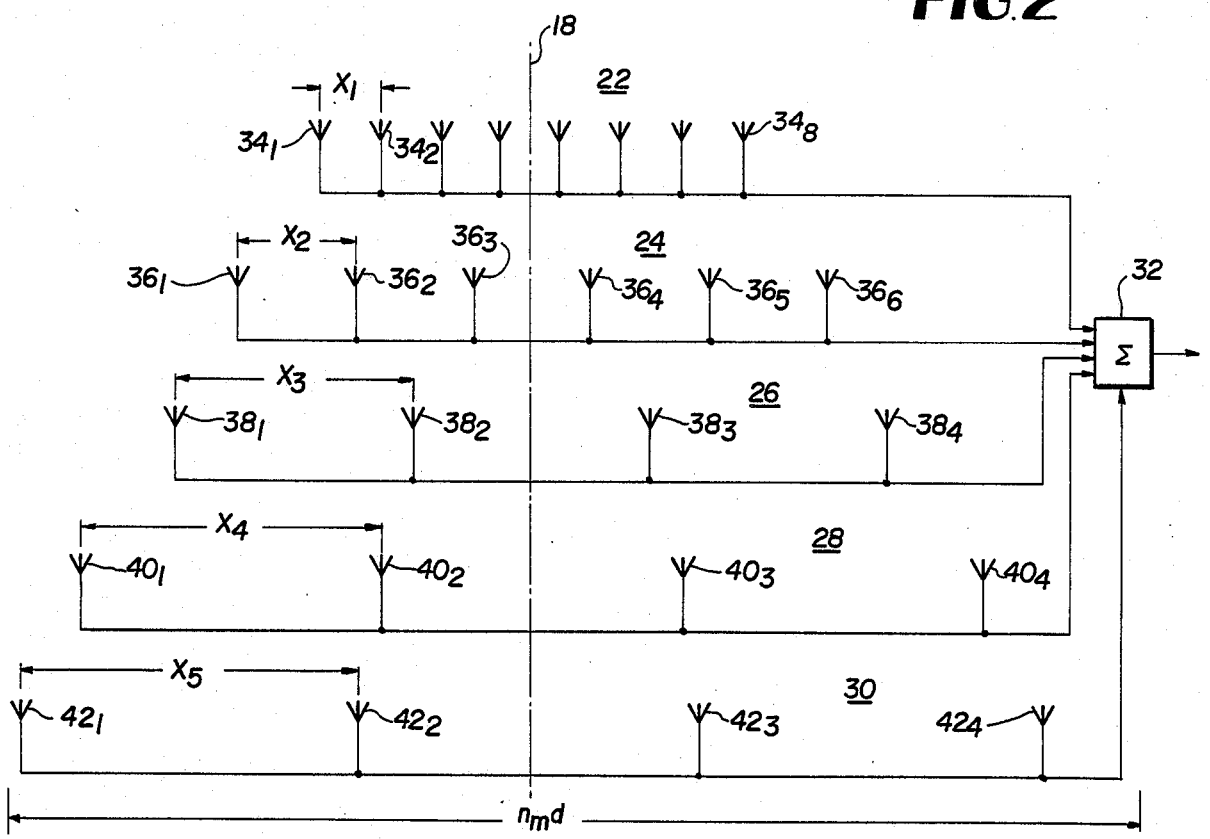
FIG. 2 is a schematic diagram of five subarrays whose elements are positioned in accordance with the principles of the subject invention.

Referring now to FIG. 2, the present invention contemplates employing the plurality of subarrays having sin mx/sin x patterns whose elements are positioned in accordance with the foregoing design procedure. As shown, five subarrays 22, 24, 26, 28 and 30 are coupled to a signal combiner 32. The subarray 22 is comprised of antenna elements $\mathbf{34}_1$ through $\mathbf{34}_8$ which have mutual equal spacings of $x_1$. With respect to the subarray 24, it is comprised of elements $\mathbf{36}_1$ through $\mathbf{36}_6$ which have an equal element spacing of $x_2$. In a like manner, the subarrays 26, 28 and 30 are comprised of elements $\mathbf{38}_1 \ldots \mathbf{38}_4$, $\mathbf{40}_1 \ldots \mathbf{40}_4$, $\mathbf{42}_1 \ldots \mathbf{42}_4$, respectively, having respective element spacings of $x_3$, $x_4$ and $X_5$.

Thus what has been shown and described is a procedure for reducing the lobes of an array antenna by controlling both elements, amplitudes and space positions by using sums of antenna patterns employing uniform subarrays whose element positions are constrained within a predetermined maximum array antenna length to produce a composite antenna pattern in accordance with the design equation (18).

I claim:

1. A coded linear array antenna, comprising:

a plurality of uniform multiple element subarrays each providing a sin mx/sin x antenna pattern, each said subarray including a plurality of antenna elements mutually spaced equidistantly apart within a predetermined maximum array antenna length along a respective common linear axis and positioned symmetrically one each side of an axis of symmetry, the maximum length L of said array being defined by $L=n_m d$ wherein $n_m$ is the maximum number of elements which can be positioned within the length of the array for a predetermined constant spacing d, each respective subarray having a different equal mutual spacing between element therein with respect to each other subarray and each having a different spacing of elements with respect to said axis of symmetry, said axis of symmetry being an array axis center common to all said subarrays, and means for combining the respective sin mx/sin x antenna patterns formed by each said subarray into a composite antenna pattern.

2. The array antenna as defined by claim 1 wherein the positioning of the individual elements of each subarray from one end of the array is determined in accordance with the normalized equation, $$n'_i = \frac{n_m}{2} - \left(\frac{h-1}{2}\right) n + (i-1)n$$

where $i=1, 2, 3, \ldots h$, $n_m$ defines said maximum number of elements $L=n_m d$, h is the number of elements in said subarray, and n is equal to the ratio of the desired element spacing x and said spacing d or $n=(x/d)$.

3. A method of positioning the individual antenna elements of a linearly positioned multi-element antenna including a plurality of subarrays in which positioning of said elements in each subarray is according to the equation:

$$n_i^1 = \frac{n_m}{2} - \left(\frac{h-1}{2}\right) n + (i-1)n$$

Where $i=1, 2, 3, \ldots h$, $n_m$ defines the maximum number of elements having a predetermined uniform spacing d which can be located within a predetermined subarray length $L=n_m d$, h is the number of elements in said subarray, and n is equal to the ratio of the desired element spacing x and said spacing d or $n=x$.

4. The method of claim 3 wherein said multi-element antenna provides a sin mx/sin x antenna pattern.

5. The method of claim 4 wherein each said subarray has a different uniform spacing between elements therein with respect to each other subarray and additionally including the step of summing the antenna patterns formed by each subarray.

6. The method of claim 5 wherein each subarray share a common axis of symmetry within the aperture of said array defined by said array length.

7. The method of claim 5 and wherein each subarray shares a common linear axis.

* * * * *